US005377979A

United States Patent [19]

Long

[11] Patent Number: 5,377,979

[45] Date of Patent: Jan. 3, 1995

[54] BACKSPIN REDUCING PUTTER

[75] Inventor: Dabbs C. Long, Albany, Ga.

[73] Assignee: ProGroup, Inc., Ooltewah, Tenn.

[21] Appl. No.: 191,552

[22] Filed: Feb. 3, 1994

[51] Int. Cl.[6] ..... A63B 53/02

[52] U.S. Cl. ..... 273/80.1; 273/80.4; 273/78; 273/DIG. 8

[58] Field of Search ..... 273/167 R, 77 R, 80.1, 273/80.2, 80.3, 80.4, 80.5, 80.6, 80.7, 80.8, 80.9, 80 R, 80 B, 79, 78, 167 B, 168, 167 H, 80 C, 167 G, DIG. 8

[56] References Cited

U.S. PATENT DOCUMENTS

| | | | |
|---|---|---|---|
| 1,983,069 | 12/1934 | Cowdery | 273/80.4 |
| 2,020,048 | 11/1935 | Cook | 273/80.4 |
| 2,129,068 | 9/1938 | Reach | 273/80.4 |
| 2,153,880 | 4/1939 | Barnhart | 273/80.4 |
| 2,702,060 | 2/1955 | Bonnesen | 273/80.4 |
| 3,762,717 | 10/1973 | Johnston | 273/167 F |
| 3,770,279 | 11/1973 | Phinny | 273/167 G |
| 4,111,426 | 9/1978 | Goodwin | 273/80.1 |
| 4,138,117 | 2/1979 | Dalton | 273/164 |

FOREIGN PATENT DOCUMENTS

| | | | |
|---|---|---|---|
| 314856 | 12/1929 | United Kingdom | 273/80.4 |

*Primary Examiner*—Sebastiano Passaniti
*Attorney, Agent, or Firm*—Miller & Martin

[57] ABSTRACT

A golf putter is provided with a head that rotates to slightly increase the loft of the face during impact and thereby lifts a golf ball from a low spot on the putting surface with reduced backspin and provides the golfer with greater control of the resulting putt. In addition, the tang of the neck received within a cavity within the head is surrounded by a resilient material that not only permits the loft-increasing rotational movement but also dampens vibration from the impact between the head and the golf ball and transmits a softer more desirable feel to the golfer's hands.

20 Claims, 4 Drawing Sheets

BACKSPIN REDUCING PUTTER

BACKGROUND OF THE INVENTION

The game of golf includes the use of a variety of golf clubs to propel the contestant's golf ball toward and ultimately into the designated golf holes. Most of the golf clubs are designed to loft a struck golf ball into the air for some considerable distance. The area of the golf course immediately surrounding each golf hole is the green, a plot of carefully tended turf to facilitate the use of another type of golf club, the putter. A putter is designed with relatively little loft, or even no loft at all, to roll a struck golf ball across the green in the direction of the hole. Because putting strokes will typically comprise from one-third to one-half of a contestant's strokes in any given round of golf, a contestant's skill at putting is one of the most important aspects of the game. Considerable attention has therefore been devoted to putter design and as a result there are many putters known in the prior art.

Most putter designs have been developed to improve the accuracy of contestants' putting. These designs focus on facilitating the contestants' alignment of the putter; minimizing torque or twisting of the putter head on contact with the golf ball; minimizing the turning moment if the golf ball is not struck precisely on the center of gravity of the putter; and facilitating the contestants' swinging of the putter head in the manner of the arc of a pendulum. In virtually all cases, prior art putter designs address the physics of putting as if the golf course greens were a smooth, firm, planar surface such as a pool table rather than the somewhat less perfect topography of real turf.

In the real world, there is frequently a problem with the lie or resting place of a golf ball in the green where it has to be putted. Gravity usually causes the golf ball to settle into a low spot in the green as opposed to a high spot and this dictates that putter heads should be lofted slightly in order to lift the golf ball from a low resting place. A typical putter head will have a loft of 1° to 6° from the vertical and this loft imparts a backwards spinning rotation to the golf ball as it is struck and lifted from its resting place. The "backspin" enhances the tendency of the golf ball to bounce or skip as the ball first contacts the surface of the green until its forward movement and friction with the surface of the green causes the spin of the golf ball to reverse and the ball then spins forward in the direction of the ball's path.

The present putter design is intended primarily to reduce the amount of backspin on a putted golf ball while still allowing the golf ball to be lifted from a low spot on the green. The reduced backspin allows for smoother and more predictable putting. In the preferred design of the present improved putter design, a resilient material such as silicone is also used to reduce vibrational shock transmission from ball impact through the putter shaft to the hands of the golfer. The improved feel from this reduced shock allows golfers to putt more smoothly and more confidently.

SUMMARY OF THE INVENTION

The putter of the invention is constructed with a novel connection between the head and neck. The tang of the neck is attached at the bottom of the putter head. The tang preferably has a relatively thin cross section in the line of the stroke so that it will flex slightly when the putter is stroked and contact is made with the golf ball.

An opening or cavity receiving the tang in the head is slightly oversized and the space between the tang and head is filled with silicone or another resilient material. When a golf ball is hit, the head is allowed to rotate upwardly, thereby imparting reduced backspin and increased loft to the golf ball in a manner known as the gear effect. The use of silicone also dampens the vibrational response of the impact as it makes its way from head to shaft, and thence to the hands of the contestant or golfer.

It is an object therefore of the present invention to provide an improved putter which imparts reduced backspin to a putted golf ball and thereby improves the accuracy of the putt.

It is a further object of the invention to provide a putter which reduces the vibrational shock transmitted from the head to the hands of the golfer.

DETAILED DESCRIPTION

Figure 1:
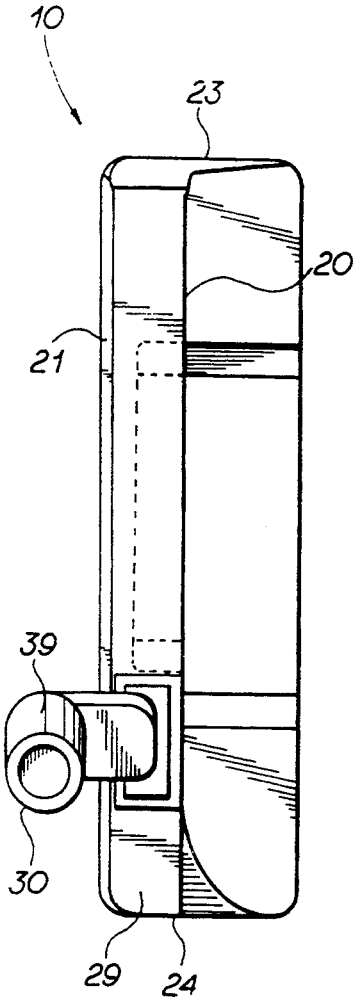
FIG. 1 is a top plan view of a golf putter head according to the present invention.
Figure 2A:
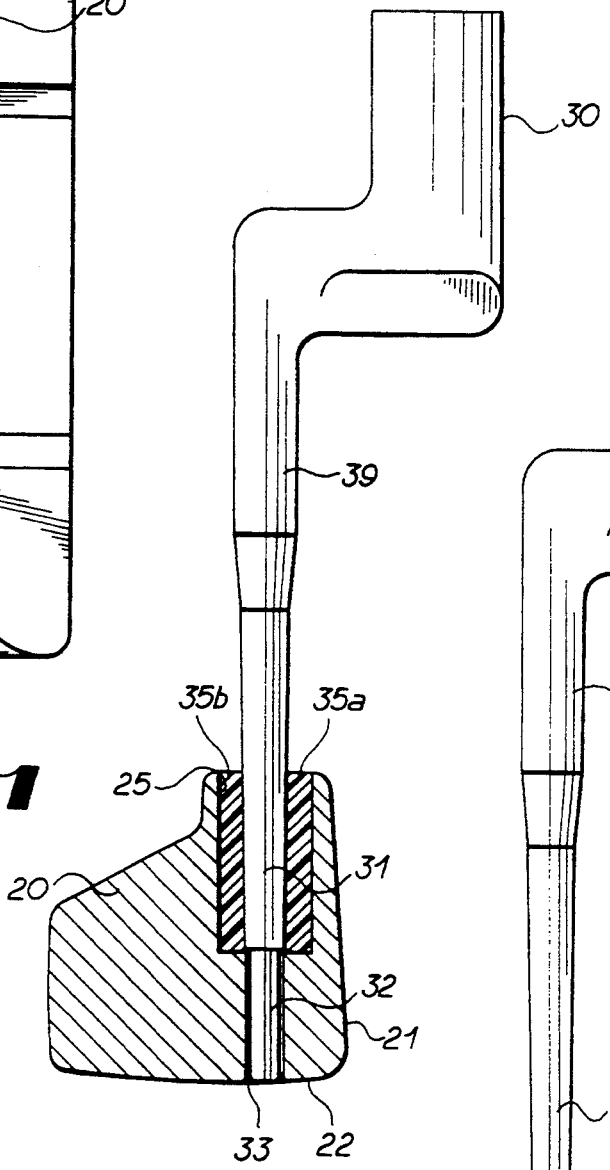
FIG. 2A is a cross sectional side elevation view of a golf putter head according to the present invention.

In FIG. 1, numeral 10 refers to a putter generally with a shaft and grip, not shown, neck 39 with hosel 30 for receiving the shaft and head 20. The head 20 has a heel 24, a toe 23, a top ridge 29 and an elongated striking face 21. FIG. 2A illustrates an embodiment of the present invention where the neck 39 ends with a tang 31 that is received within a cavity 25 of the head 20. The cavity 25 is sized slightly larger than the tang 31 of the neck 30 and a tight fit between the tang 31 and the head 20 is provided by filling the cavity 25 with a resilient material 35 such as silicone or urethane. One suitable silicone rubber is marketed under the brand name RTV by Dow Corning, an example of a suitable urethane would be PMC-746 marketed by Smooth-On, Inc. of Gillette, N.J.

In the presently preferred embodiment the tang end 32 narrows or tapers and is received into the bottom of the cavity 25 proximate to the sole 22 of the head 20. The narrowing of the tang end 32 increases its flexibility. Preferably, the tang end 32 should be rectangular or oblong so that it has a relatively thin cross-section in the line of the stroke and a relatively thick cross-section perpendicular to the line of the stroke. This provides the tang 31 or tang end 32 with a propensity to flex in the line of the stroke yet sufficient stiffness to resist twisting of the putter head 20 if the golf ball is not struck on the center of gravity of the putter. The cavity 25 may extend vertically through the putter head 20, as illustrated, and the tang end 32 may be plug welded or otherwise fastened where it emerges through the bottom 33 of the cavity 25 along the sole 22 of the head 20. The silicone or other resilient material 35 is preferably filled into the extra space in the cavity 25 after the tang end 32 has been welded to the head 20. The upper portion of the cavity 25 should be sized to permit approximately 0.03 to 0.2 inches of resilient material 35*a* to be located forward of the tang 31 and approximately 0.03 to 0.2 inches of resilient material 35*b* to be located rearward of the tang 31. The presently preferred thickness of the resilient material forward or rearward of the tang is about 0.0625 inches.

Figure 2B:
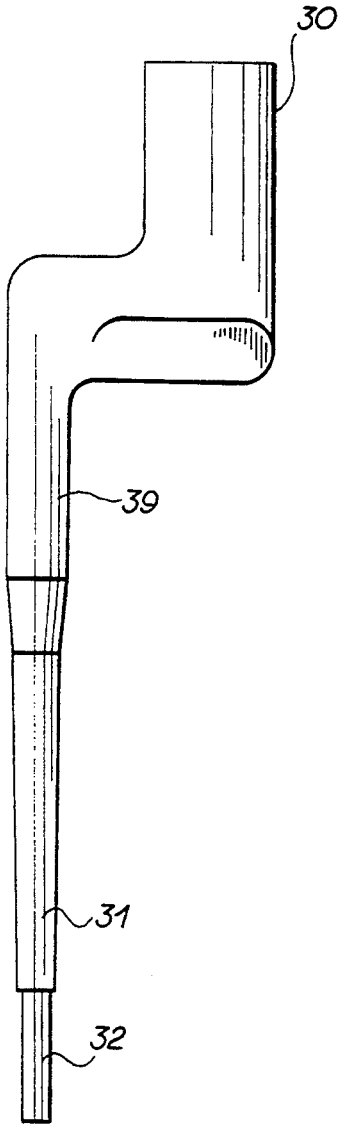
FIG. 2B is a side plan view of a neck adapted to be used in accordance with the present invention.
Figure 3:
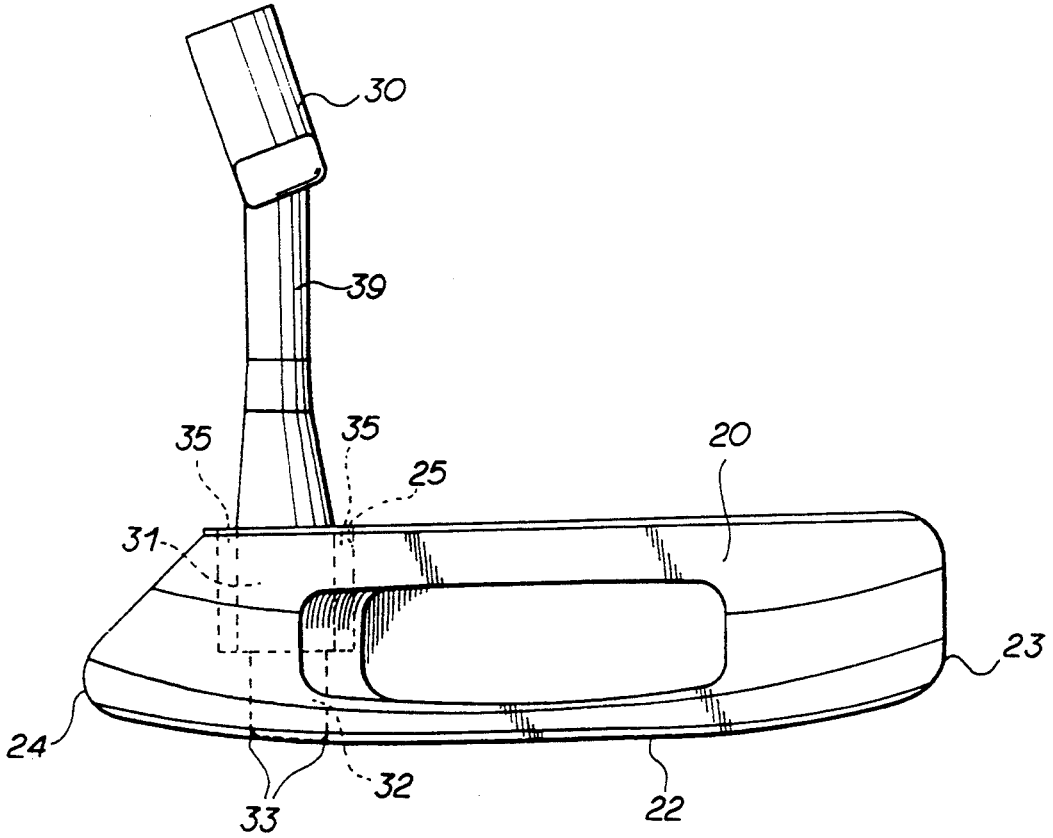
FIG. 3 is a rear elevation view of a golf putter head according to the present invention.
Figure 4:
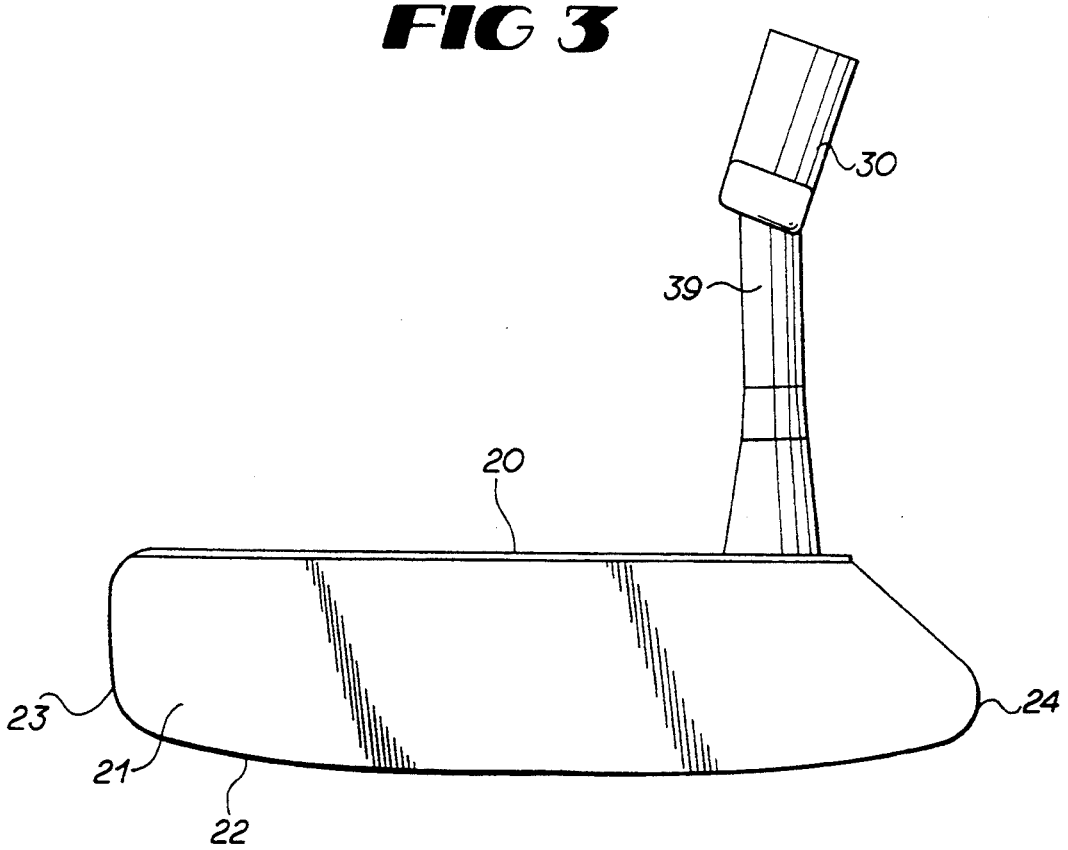
FIG. 4 is a front elevation view of a golf putter head according to the present invention.

FIG. 2B shows the neck 39 in isolation with the hosel 30 at the proximate end to receive the shaft, not pictured, and the tang 31 and the tang end 32 at the opposite distal end. FIG. 3 shows a head 20 according to the present invention receiving tang 31 in cavity 25. The tang end 32 narrows and is welded along the sole 22 of the head 20 at the bottom 33 of the cavity 25 where it would have protruded. FIG. 4 shows the face 21 of the head 20.

Figure 5A:
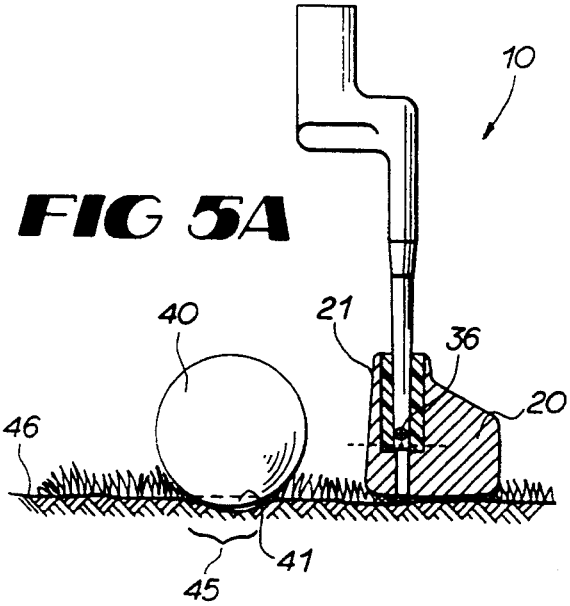
FIG. 5A is a side view of a putter according to the present invention ready to be swung forward to strike a golf ball.
Figure 5B:
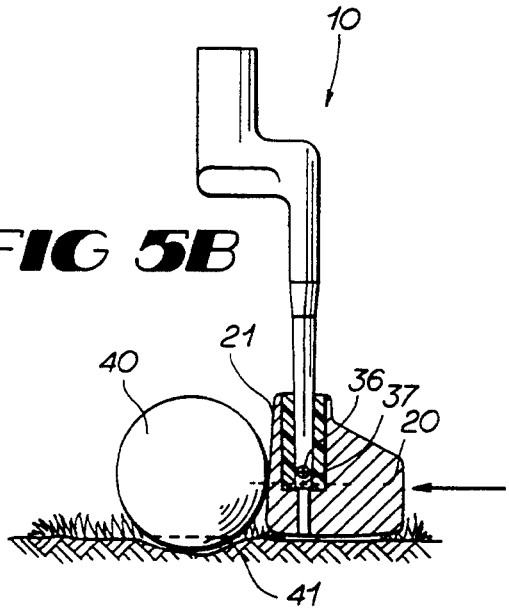
FIG. 5B is a side view of a putter according to the present invention at the instant of impact with a resting golf ball.

FIGS. 5A through 5D show a putter according to the present invention in use. In FIG. 5A, the putter 10 is ready to swing forward and strike the golf ball 40 which is resting in a low spot 45 of the putting surface 46. The bottommost portion 41 of the golf ball 40 is in the low spot 45 and is actually slightly below the plane of the surrounding putting surface 46. The face 21 of the head 20 has approximately 2° of loft. In FIG. 5B the putter 10 is swung forward to the point of impact.

Figure 5C:
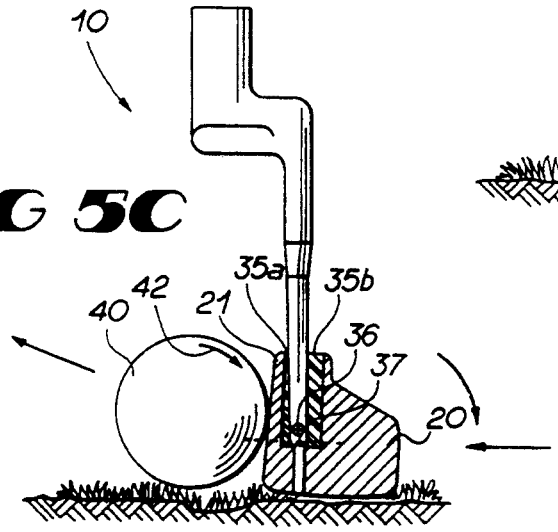
FIG. 5C is a side view of a putter according to the present invention striking a golf ball at the instant the golf ball is moving forward off the putter blade.
Figure 5D:
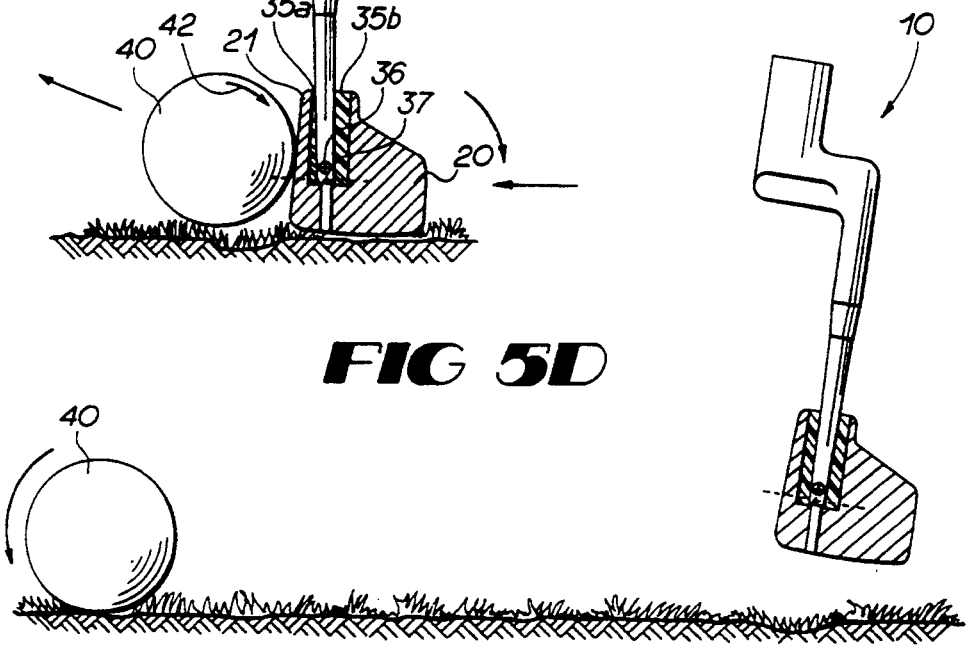
FIG. 5D is a side view of a putter according to the present invention after striking a golf ball.
Figure 6A:
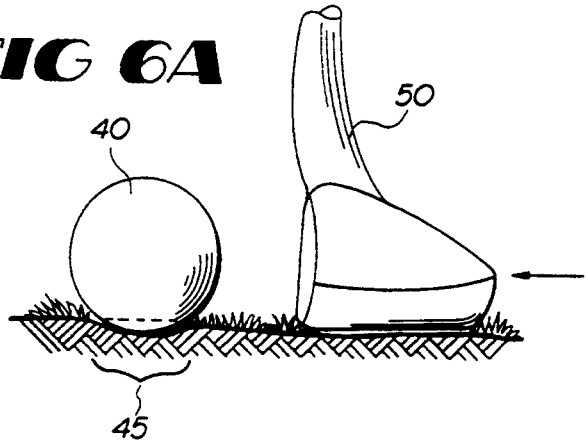
FIG. 6A is a side view of a traditional putter ready to be swung forward to strike a golf ball.
Figure 6B:
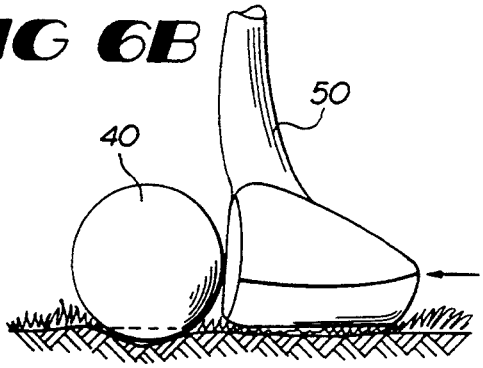
FIG. 6B is a side view of a traditional putter at the instant of impact with a resting golf ball.
Figure 6C:
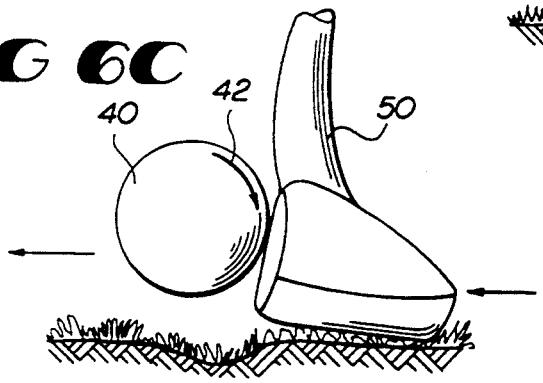
FIG. 6C is a side view of a traditional putter striking a golf ball at the instant the golf ball is moving forward off the putter blade.
Figure 6D:
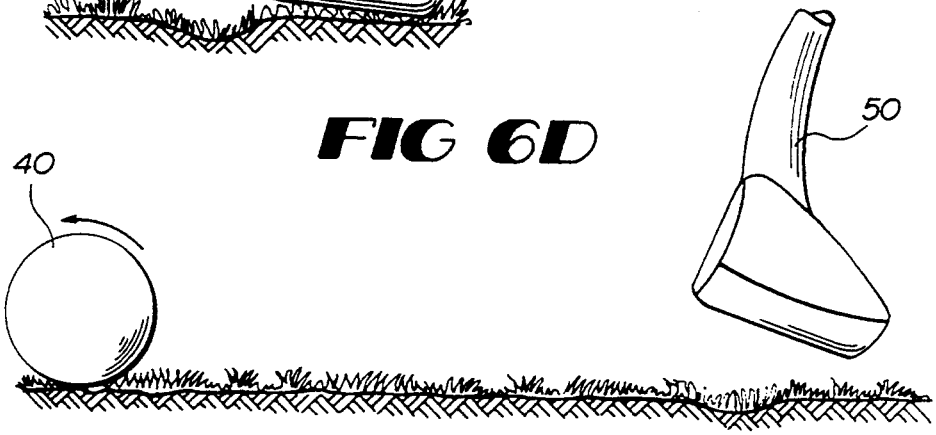
FIG. 6D is a side view of a traditional putter after striking a golf ball.

In FIG. 5C, during the impact of the head 20 with the golf ball 40, the inertial resistance of the golf ball 40 has caused the head 20 to rotate in a clockwise fashion around its rotational axis 37 so that the face 21 of the head 20 now has additional loft. The rotation of the head 20 is accomplished by compressing the resilient material 35*a* between the tang 31 and the face 21 of the head 20 and stretching the resilient material 35*b* rearward of the tang 31.

To best effect rotation of the head 20, the center of gravity 36 of the head 20 should be located between the sole 22 of the head 20 and the point at which the golf ball 40 will impact the face 21 which is approximately 0.84 inches above the sole 22. The preferred center of gravity is located approximately 0.6 inches above the sole 22 of the head 20. The rotational axis 37 of the head is controlled by the shape of the tang 31 and tang end 32 and its fastening to the head 20. To effect rotation of the putter head 20, the rotational axis 37 must also be located between the sole 22 of the head 20 and the point at which the golf ball will impact the face 21, approximately 0.84 inches above the sole 22. Preferably, the rotational axis 37 is located below the center of gravity 36 and approximately 0.25 to 0.5 inches above the sole 22 of the head 20.

As the golf ball 40 encounters the lofted face 21 of the head 20, the golf ball 40 tends to roll clockwise up the face 21 of the head 20, creating "back spin". However, the rotation of the head 20 imparts a reduced backspin 42 to the ball 40 as the ball 40 is lifted from the low spot 45 in the putting surface 46. The reduced rotation provided by the present head 20 is sometimes referred to in the art as the "gear effect."

Backspin 42 produces a skipping, sliding or bouncing motion by the golf ball 40 as it first contacts the putting surface 46 after being struck by the putter 10. As the golf ball 40 contacts the putting surface 46 friction acts to reverse the backspin 42 so that the golf ball eventually begins to roll counterclockwise in the direction of the line of the putting stroke. The reduced backspin 42 from the present invention allows the golf ball 40 to more quickly begin rolling in the line of the stroke and reduce the skipping, sliding or bouncing motions of the golf ball 40 which are less predictable than a rolling motion and are considered undesirable by golfers.

A further advantage of the present invention is that by encasing the tang 31 of the neck 39 in a resilient material 35 or vibration absorbing polymer such as silicone, immediately above its attachment point but still inside the putter head, the vibrational response of the impact between the golf ball 40 and head 20 is dampened and provides a softer more desirable feel to the hands of the golfer.

FIGS. 6A through 6D show a standard putter 50 being used to strike a similarly situated golf ball 40. Note that in FIG. 6C, the golf ball 40 has rolled clockwise further up the face 21 of the head 20 than it does with an improved putter according to the present invention as shown in FIG. 5C. A more substantial backspin 42 is thereby imparted to the golf ball 40 in order to lift it from the low spot 45 on the putting surface 46.

Numerous alterations of the structure herein described will suggest themselves to those skilled in the art. It will be understood that the details and arrangements of the parts which have been described and illustrated in order to explain the nature of the invention are not to be construed as any limitation of the invention. All such alterations which do not depart from the spirit of the invention are intended to be included within the scope of the appended claims.

I claim:

1. A golf putter head comprising:

(a) a head having a striking face and a cavity;

(b) a neck having a distal end and a proximate end;

(c) a hosel on the proximate end of said neck; and (d) a tang on the distal end of said neck, said tang being smaller than the cavity in the head and being received within and fastened at a bottom of the cavity, and said tang being further encircled with a resilient material within said cavity.

2. A golf putter head in accordance with claim 1 wherein the cavity is sized to permit approximately 0.03 to 0.2 inch of resilient material to be located forward of the tang and approximately 0.03 to 0.2 inch of resilient material to be located rearward of the tang.

3. A golf putter head in accordance with claim 1 wherein the head has a striking face and the tang has a relatively thin cross-section in the direction perpendicular to the striking face and a relatively thicker cross-section in the direction parallel to said striking face.

4. A golf putter head in accordance with claim 1 wherein the tang flexes more easily in the line perpendicular to the striking face than along any other axis.

5. A golf putter head in accordance with claim 1 wherein the head has a sole and a center of gravity, and the center of gravity of the head is located between the sole of the head and the point at which a golf ball struck by the golf putter head would impact the striking face.

6. A golf putter head in accordance with claim 5 wherein the center of gravity of the head is located approximately 0.6 inch above the sole of the head.

7. A golf putter head in accordance with claim 1 wherein the head has a rotational axis and a sole and said rotational axis is located between the sole of the head and the point at which a golf ball struck by the golf putter head would impact the striking face.

8. A golf putter head in accordance with claim 7 wherein the head has a center of gravity and the rotational axis of the head is located below the center of gravity of the head.

9. A golf putter head in accordance with claim 7 wherein the rotational axis of the head is located approximately 0.25 to 0.5 inch above the sole of the head.

10. A golf putter head in accordance with claim 1 wherein said resilient material is selected from the group consisting of silicone or urethane.

11. A golf putter comprising:

(a) a shaft with a distal end and a proximate end;
(b) a grip on the proximate end of said shaft;
(c) a neck having a distal end and a proximate end;
(d) a hosel on the proximate end of the neck which receives the distal end of the shaft;
(e) a tang on the distal end of said neck, said tang having a tang end of relatively thin cross-section in a first direction and of relatively thick cross-section in a second direction perpendicular to said first direction;
(f) a head having a forward striking face, and a sole;
(g) a cavity within the head larger than said tang and wherein said tang end is fixed so that the relatively thick cross-section of the tang end is parallel to the forward striking face;
(h) a resilient material within the cavity encircling the tang so that approximately 0.25 to 0.5 inch of said resilient material is located forward of the tang;
(i) a center of gravity of said head located approximately 0.4 to 0.8 inch above the sole of the head; and
(j) a rotational axis of said head located approximately 0.25 to 0.5 inch above the sole of the head.

12. A golf putter head comprising:

(a) a neck with a distal end and a proximate end;
(b) a hosel on the proximate end of said neck;
(c) a tang on the distal end of said neck;
(d) a head having a cavity larger than said tang; wherein said tang is fixed to the head within said cavity; and
(e) a resilient material forward of the tang within the cavity.

13. A golf putter head in accordance with claim 12 wherein the cavity is sized to permit approximately 0.03 to 0.2 inch of resilient material to be located forward of the tang.

14. A golf putter head in accordance with claim 12 wherein the head has a striking face and the tang has a relatively thin cross-section in the direction perpendicular to the striking face and a relatively thicker cross-section in the direction parallel to said striking face.

15. A golf putter head in accordance with claim 12 wherein the head has a sole and a center of gravity and said center of gravity is located approximately 0.4 to 0.8 inch above the sole.

16. A golf putter head in accordance with claim 12 wherein the head has a rotational axis and a center of gravity and said rotational axis is located below said center of gravity.

17. A golf putter head in accordance with claim 12 wherein the head has a rotational axis and a sole and said rotational axis is located approximately 0.25 to 0.5 inch above the sole.

18. An improved golf putter in which a shaft with a distal end and a proximate end has a grip on said proximate end and in which a neck with a distal end and a proximate end has a hosel on the proximate end for receiving the distal end of said shaft, and in which a tang is positioned on the distal end of said neck, and in which a head with a striking face is fixed to said tang, wherein the improvement comprises:

(a) said head having a cavity larger than said tang and said tang being fixed to the head within said cavity;
(b) a resilient material encircling the tang within the cavity; and
(c) said tang having a relatively thin cross-section in the direction perpendicular to the striking face of the head.

19. A golf putter in accordance with claim 18 wherein the cavity is sized to permit approximately 0.03 to 0.2 inch of resilient material to be located forward of the tang and approximately 0.03 to 0.2 inch of resilient material to be located rearward of the tang.

20. A golf putter in accordance with claim 18 wherein the tang flexes more easily along the plane of the stroke than along any other axis.

* * * * *